US006604473B2

(12) United States Patent
Felsenthal

(10) Patent No.: US 6,604,473 B2
(45) Date of Patent: Aug. 12, 2003

(54) LAUNDRY CENTER WITH IRONING BOARD

(76) Inventor: Sandy Alan Felsenthal, 5428 Collingwood Cove, Memphis, TN (US) 38120

( * ) Notice: Subject to any disclaimer, the term of this patent is extended or adjusted under 35 U.S.C. 154(b) by 106 days.

(21) Appl. No.: 09/940,520

(22) Filed: Aug. 29, 2001

(65) Prior Publication Data

US 2003/0042826 A1 Mar. 6, 2003

(51) Int. Cl.[7] ..... A47F 7/02

(52) U.S. Cl. ..... 108/107; 108/135; 108/147.13; 211/187; 211/85.24

(58) Field of Search ..... 108/106, 107, 108/147.12, 147.13, 147.15, 147.17, 108, 134, 135; 211/85.3, 85.8, 85.15, 85, 85.24, 187, 123

(56) References Cited

U.S. PATENT DOCUMENTS

| | | | | | |
|---|---|---|---|---|---|
| 1,532,973 | A | | 4/1925 | Adelson | |
| 1,700,924 | A | | 2/1929 | Cushman | |
| 2,625,973 | A | * | 1/1953 | Weldon | 206/459.5 |
| 2,904,383 | A | | 9/1959 | Potts | |
| 4,092,973 | A | | 6/1978 | Bernazzani | |
| 4,157,070 | A | * | 6/1979 | Huempfner et al. | 108/28 |
| 4,186,666 | A | * | 2/1980 | Honickman | 108/29 |
| 4,672,703 | A | * | 6/1987 | Frazier | 5/503.1 |
| 5,294,009 | A | * | 3/1994 | Maurer et al. | 211/126.15 |
| 5,381,738 | A | * | 1/1995 | Meyer | 108/42 |
| 5,570,642 | A | | 11/1996 | Lehrman | |
| 5,601,038 | A | * | 2/1997 | Welch et al. | 108/193 |
| 5,865,517 | A | | 2/1999 | Wang | |
| 5,947,307 | A | * | 9/1999 | Battaglia et al. | 211/187 |
| 5,960,968 | A | * | 10/1999 | Wang | 211/187 |
| 5,967,342 | A | * | 10/1999 | Steffine | 211/85.24 |
| 6,047,750 | A | | 4/2000 | Jensen | |
| 6,158,600 | A | * | 12/2000 | Ferrucci et al. | 211/90.02 |
| D459,044 | S | * | 6/2002 | Felsenthal | D32/66 |

* cited by examiner

*Primary Examiner*—Janet M. Wilkens
(74) *Attorney, Agent, or Firm*—William D. Breneman; Peter J. Georges; Breneman & Georges

(57) ABSTRACT

A laundry center has a plurality of grooved vertical posts connecting together a top storage shelf and a middle snake wire frame. Plural sorting sacks are attached to the middle snake wire frame by ties. A height-adjustable, downwardly foldable ironing board is secured to two of the grooved vertical posts. Because the ironing board must be pulled up to be used, no one is injured when the ironing board is disengaged from its stored position.

20 Claims, 3 Drawing Sheets

LAUNDRY CENTER WITH IRONING BOARD

BACKGROUND OF THE INVENTION

1. Field of the Invention

The present invention relates generally to supports, shelves and receptacles, but more particularly to a movable laundry sorter with a height-adjustable, downwardly foldable ironing board.

2. Description of the Related Art

Many types of laundry sorters with and without hanging bars are on the market.

For example, on Apr. 7, 1925, a height-adjustable, screw-jack type ironing board received U.S. Pat. No. 1,532,973 for Sophia Adelson.

On Feb. 5, 1929, Ella M. Cushman received U.S. Pat. No. 1,700,924, for a stationary sewing cabinet with shelves, a hanging bar, and an upwardly foldable ironing board. However, when the board is unlatched, it can fall down and injure someone.

Much later, on Sep. 15, 1959, U.S. Pat. No. 2,904,383 was issued to Melvin W. Potts for a wheeled rack for carrying athletic equipment. Although there are two bins and hanging bars, there is no ironing board attached thereto.

Richard J. Bernazzani received U.S. Pat. No. 4,092,973 on Jun. 6, 1978, for a nonwheeled, collapsible, outdoor, cooking range for use by the U.S. Army. Although it has some structure similar to the present invention, it is not used for the same purpose.

An upwardly foldable ironing board with an attached basket for supplies was the subject of U.S. Pat. No. 5,570,642 which issued to David Lehrman on Nov. 5, 1996. Again, when the board is unhooked, it can rotate quickly downward by gravity and hit the user.

On Feb. 2, 1999, Wen-Tsan Wang received U.S. Pat. No. 5,865,517 for a wheeled coat rack and cabinet.

Most recently, U.S. Pat. No. 6,047,750 was granted to Steven M. Jensen on Apr. 11, 2000, for a modular utility stand and storage apparatus having a plurality of stacked components.

SUMMARY OF THE INVENTION

A primary object of the present invention is to provide sorting bins with overhead hanging bars and a safe, height-adjustable, downwardly foldable ironing board so as to make a complete laundry center, unlike the prior art ironing boards which fold upwardly and may injure someone when the board is disengaged for use. Because the collapsed ironing board of the present invention must be pulled up to be used, no one is injured when the ironing board is disengaged from its stored position.

The laundry center includes locking wheels for stability as well as movability when the unit is not being used for sorting, ironing and hanging clothes.

The laundry center permits the user to sort laundry in two, three of more bins that can be made of various materials, such as cloth, vinyl or the like. These bins or flexible sacks can be attached to the unit with plastic, wire or VELCRO® ties which can be easily removed to allow the user to reposition or replace a bin or sack.

The laundry center has bars over the sorting bins or sacks so that a user can hang clothing thereon, once washed and dried, either before or after ironing, all within the confines of the laundry center.

The collapsible ironing board folds down when not is use. When someone desires to press a piece of clothing, the ironing board is lifted and an arm, which is locked into place on an underside of the board, is rotated and clipped into place so as to support the board.

Various locking devices can be used to secure the arm into place once it is rotated to a desired position.

The height of the ironing board may be adjusted in one-inch increments by plastic connectors that attach the board to vertical posts of the laundry center. The board can be adjusted up or down by repositioning these plastic connectors over grooves spaced apart along the vertical posts of the laundry center.

Shelving and other attachments are secured to the vertical posts by the same plastic connectors. For example, one attachment, secured by a plastic connector, is a wire basket for storing an iron and other supplies, such as starch spray cans, so that they are within easy reach of a consumer who is using the attached ironing board.

Hooks for supporting and storing an independent ironing board may be provided, in addition to the attached ironing board, in an alternative embodiment.

In addition to the wire basket for storing the iron and supplies, the laundry center may include a hanging storage bag which has pocket compartments for miscellaneous laundry items, such as detergent, starch, a water sprinkler, etc. This storage bag may be placed on a side of the laundry center opposite to the side where the ironing board is located, if the wire basket is attached to the same side as the ironing board.

A shelf is arranged on top of the laundry center for storing large items out of the way of the user.

These features and other objects of the present invention will be more readily apparent from the following brief description of the drawings and the subsequent detailed discussion of the invention.

DETAILED DESCRIPTION OF THE INVENTION

Figure 1:
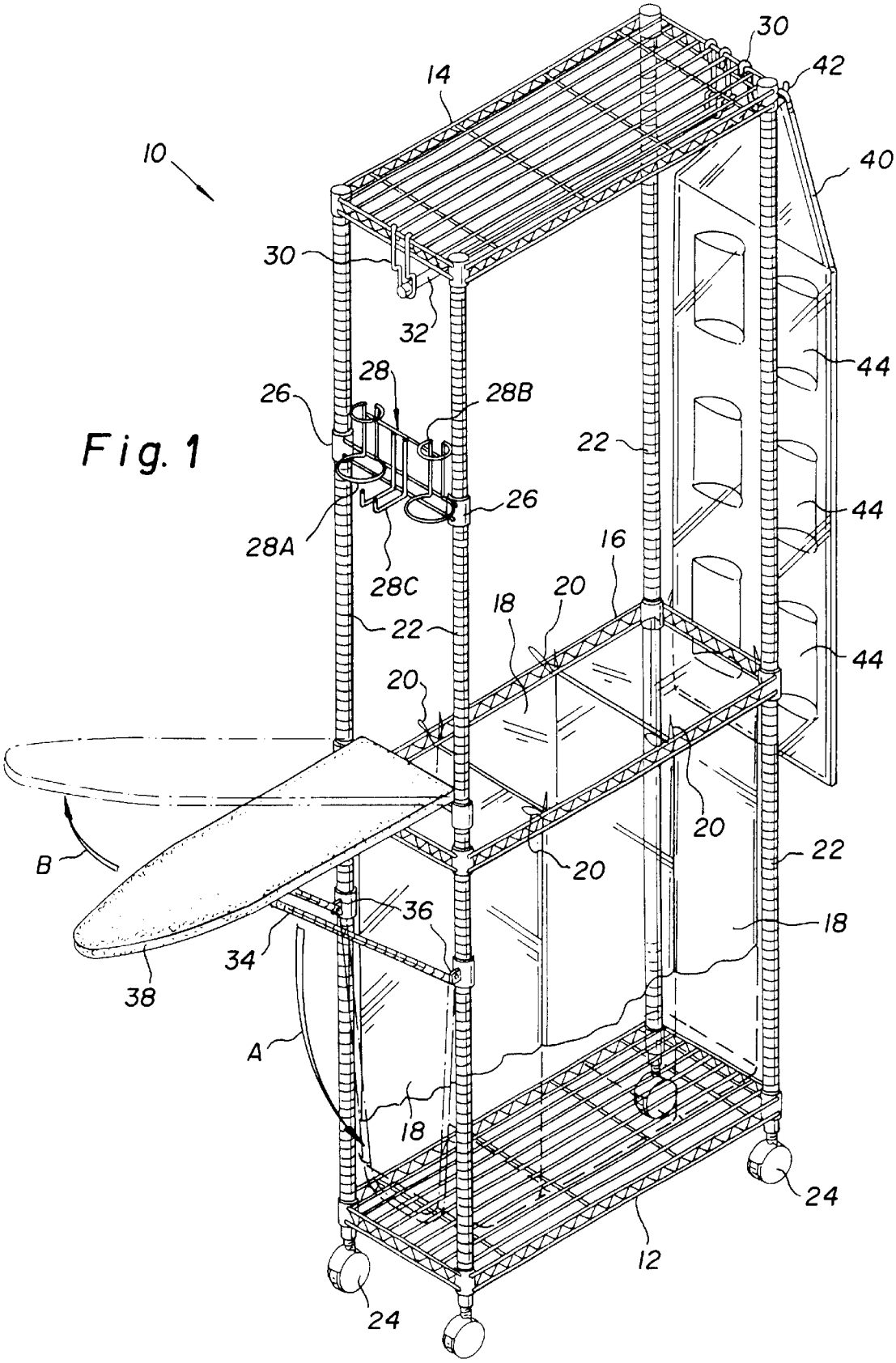
FIG. 1 is a front perspective view of a first embodiment of the present invention.

In FIG. 1, a laundry center 10 has a bottom wire shelf 12, a top wire shelf 14 for storage, and a middle "snake" wire frame 16. The frame 16 is called "snake" because its wire has a sinusoidal shape.

Plural bins or flexible sacks 18, e.g. two, three or more, are secured to the middle snake wire frame 16 by a plurality of ties 20, which may be plastic, wire or VELCRO®.

Four vertical posts 22, which are preferably grooved metal tubes, connect the bottom shelf 12, the middle snake frame 16 and the top shelf 14 together to form the laundry center 10 as a single unit that may be movable on wheels 24 which may be locked in place at the bottom of the vertical posts 22.

A first pair of plastic snap-on connectors 26 secures a wire basket 28 between two posts 22. The connectors 26 may be positioned anywhere along the posts 22 so that the basket 28 is located at a comfortable height for a user.

The basket 28 has two side portions 28A and 28B for holding cylindrical cans, such as those containing spray starch, and a central wire portion 28C for securing an iron when not in use.

Brackets 30 hold opposite ends of a hanging bar 32 suspended underneath the top shelf 14 and over the sacks 18. The bar 32 is used for hanging clothing therefrom.

A U-shaped arm 34 is rotated about hinges 36 in a direction of an arc A to engage with and disengage from an underside of an ironing board 38. After the arm 34 is disengaged, the board 38 is rotated slightly upward in a direction of an arc B before both the arm 34 and the board 38 are collapsed into a vertically extending downwardly position, as shown in phantom lines, between two of the four posts 22.

Optionally, a storage bag 40 may be hung from a hook 42 attached between two of the posts 22 on a side opposite to the two other posts 22 on the side on which the ironing board 38 is secured. The bag 40 has a plurality of pocket compartments 44 for storing items, such as detergent and the like.

Figure 2:
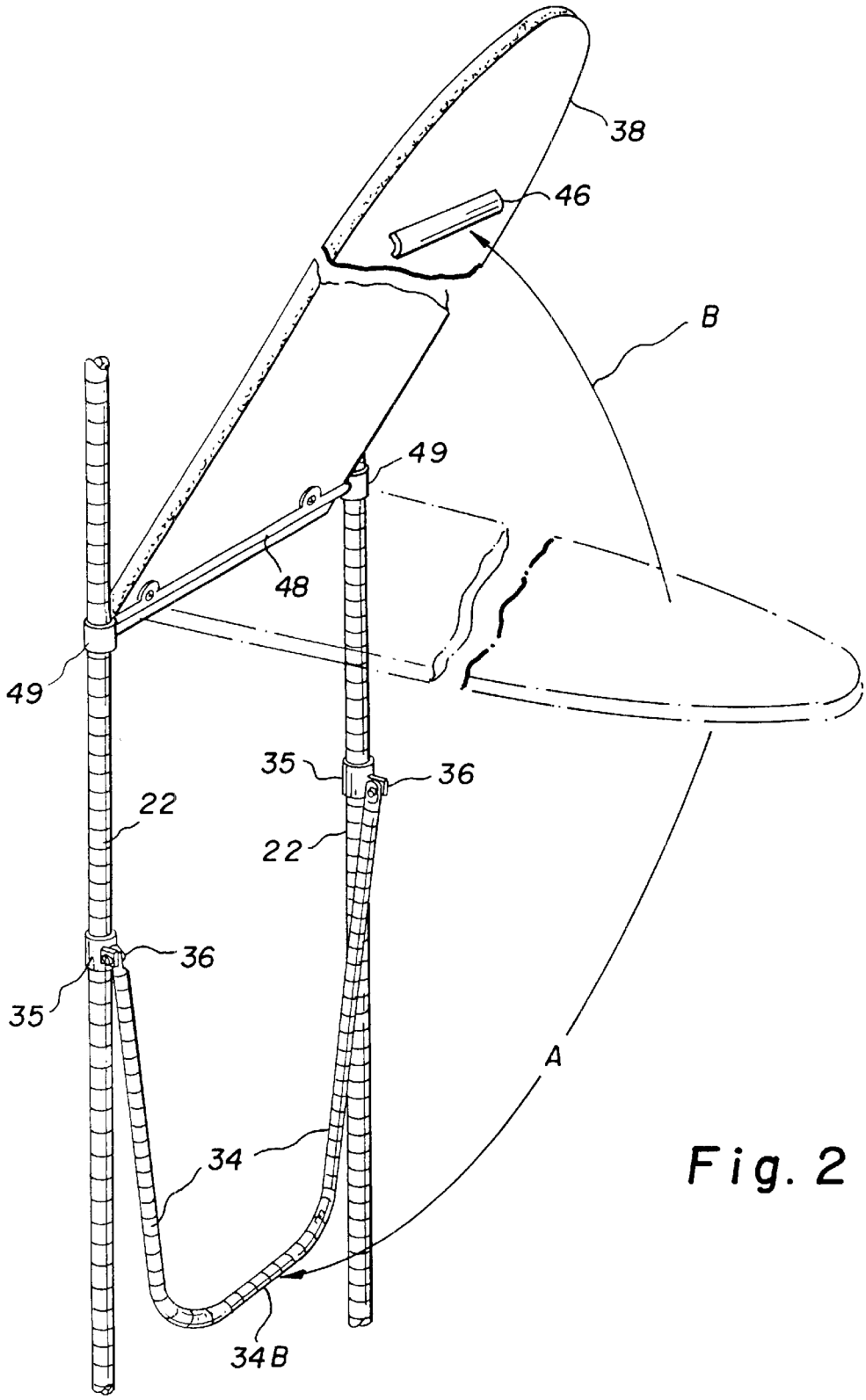
FIG. 2 shows a detailed perspective view of the collapsible ironing board of the present invention in use.

In FIG. 2, details of the operation of the collapsible ironing board 38 are shown. The underside of the board 38 has secured thereto a clasp 46 which engages with a bight 34B of the U-shaped arm 34. The clasp 46 is open on its side facing away from a free end of the board 38.

The hinges 36 allow the arm 34 to rotate into and out of a position supporting the board 38 through the arc A. A second pair of plastic connectors 35 secure the hinges 36 to the posts 22. The board 38 and the arm 34 fold downwardly when not is use.

One end of the board 38 is secured to a rotatable plate 48 extending between a third pair of plastic connectors 49 on two of the four posts 22. These connectors 49 may be relocated higher or lower in horizontally oriented grooves spaced apart at one-inch increments on the vertical posts 22 so as to place the board 38 at a position comfortable for the user.

These connectors 49 and the grooves in the vertical posts 22 together lock the ironing board 38 at any desired level. In other words, these connectors 49 are frictionally engaged with the grooves formed in the vertical posts 22. Thus, the connectors 49 and the grooves in the vertical posts 22 provide for the adjustability of the height of the ironing board 38. These connectors 49 may be obtained from Art Work Metal & Plastic Co., Ltd., of Guangdong, China.

Figure 3:
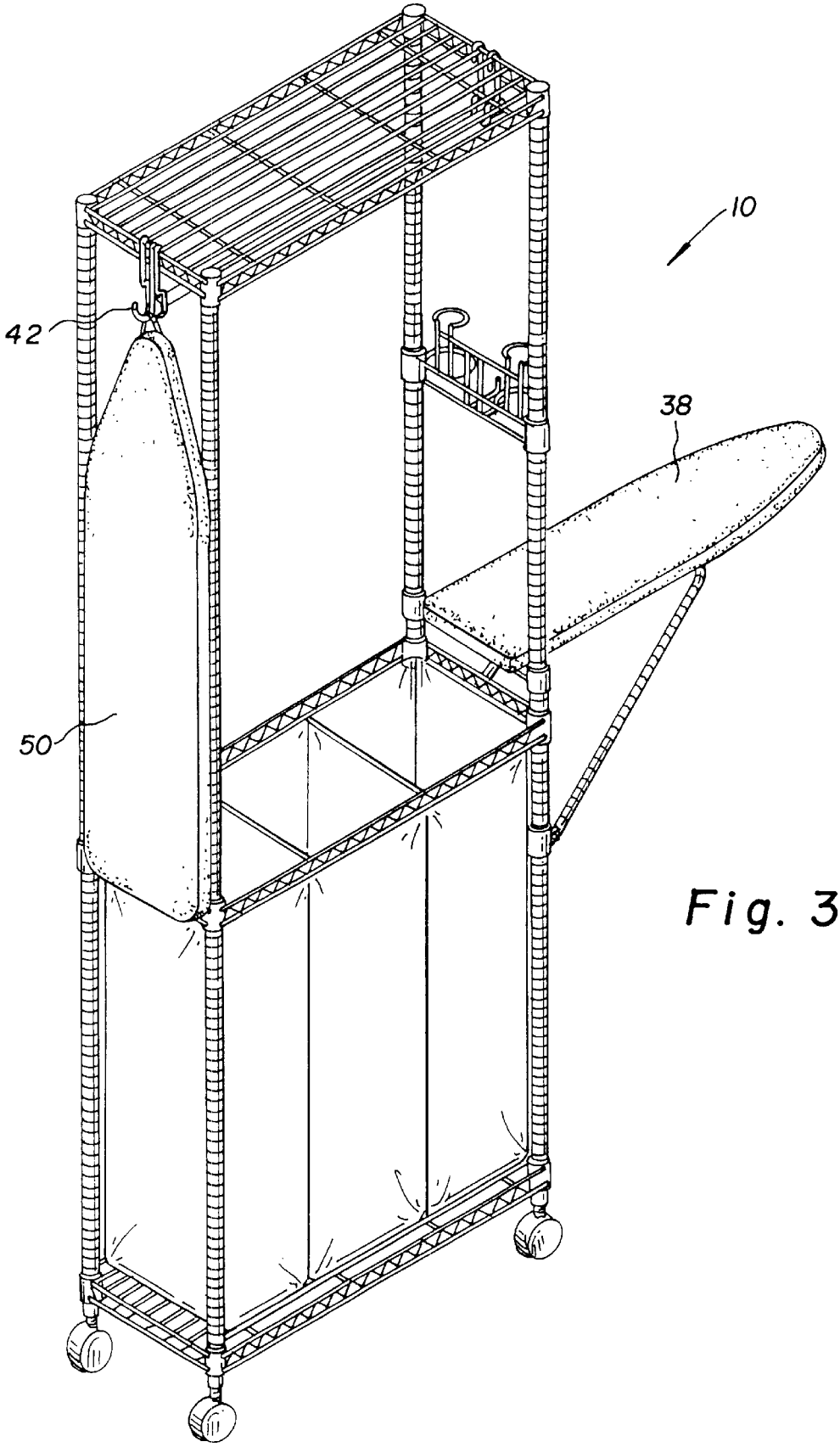
FIG. 3 shows a rear perspective view of a second embodiment of the present invention.

In FIG. 3, a second embodiment of the laundry center 10 is shown and has, instead of the storage bag 40 seen in FIG. 1, an independent ironing board 50 hanging from the hook 42.

Otherwise, the elements of the second embodiment are the same as the first embodiment. Although these elements are illustrated in FIG. 3, they are neither numbered nor discussed herein in order to avoid unnecessary repetition.

Numerous modifications and variations of the present invention are possible in light of the above teachings. Thus, it is to be understood that, within the scope of the appended claims, the invention may be practiced otherwise than as specifically described herein.

I claim:

1. A laundry center comprising:

(a) a plurality of grooved vertical posts connecting together a top storage shelf and a middle snake wire frame;

(b) a plurality of sacks, attached to the middle snake wire frame by ties, for sorting laundry; and (c) a height-adjustable, downwardly foldable ironing board secured to two of the plurality of grooved vertical posts.

2. A laundry center, according to claim 1, further comprising:

a bottom shelf connected to the plurality of grooved vertical posts.

3. A laundry center, according to claim 1, further comprising:

movable wheels which may be locked in place at bottoms of the plurality of grooved vertical posts.

4. A laundry center, according to claim 1, further comprising:

a basket secured between two of the plurality of grooved vertical posts by a first pair of connectors.

5. A laundry center, according to claim 4, wherein:

said basket has two side portions for holding cans and a central portion for securing an iron.

6. A laundry center, according to claim 1, further comprising:

brackets configured to hold opposite ends of a hanging bar suspended underneath the top shelf and over the plurality of sacks.

7. A laundry center, according to claim 1, further comprising:

a U-shaped arm, rotatable about hinges, for engaging with and disengaging from an underside of the ironing board.

8. A laundry center, according to claim 7, further comprising:

a clasp, secured to an underside of the ironing board, for engaging with and disengaging from a bight of the U-shaped arm.

9. A laundry center, according to claim 8, wherein:

said clasp is open on a side facing away from a free end of the ironing board.

10. A laundry center, according to claim 7, wherein:

said hinges are secured between two of the plurality of grooved vertical posts by a first pair of connectors.

11. A laundry center, according to claim 1, further comprising:

a hook attached between two of the plurality of grooved vertical posts opposite to the two posts to which the ironing board is secured.

12. A laundry center, according to claim 8, further comprising:

an independent ironing board hung from the hook.

13. A laundry center, according to claim 11, further comprising:

a storage bag hung from the hook.

14. A laundry center, according to claim 13, wherein:

said storage bag has a plurality of pocket compartments.

15. (Currently amended) A laundry center, according to claim 11 further comprising:

a rotatable plate secured to one end of the ironing board between two of the plurality of grooved vertical posts by a second pair of connectors.

16. A laundry center, according to claim 15, wherein:

said second pair of connectors are frictionally engageable and disengageable with grooves in the grooved vertical posts so that a height of the rotatable plate and hence the ironing board may be adjustable along the grooved vertical posts.

17. A laundry center comprising:

(a) a plurality of vertical posts having a plurality radially projecting grooves disposed along the length of said vertical posts for connecting together a top storage shelf and a bottom shelf; and (b) a height-adjustable, downwardly foldable ironing board secured to two of the plurality of grooved vertical posts and an adjustable support arm frictionally engageable and disengageable with said radially projecting grooves for supporting an underside of the ironing board.

18. A laundry center, according to claim 17, further comprising:

a pair connectors frictionally engageable and disengageable with grooves in the grooved vertical posts so that a height of the ironing board may be adjustable along the grooved vertical posts.

19. A laundry center according to claim 18, further comprising:

a middle snake wire frame connected to the plurality of grooved vertical posts.

20. A laundry center according to claim 19, further comprising:

a plurality of sacks, attached to the middle snake wire frame by ties, for sorting laundry.

* * * * *